United States Patent [19]

Gensler

[11] 4,039,391

[45] Aug. 2, 1977

[54] COKE OVEN BATTERY AND METHOD FOR OPERATION ON A SLOW-DOWN BASIS

[75] Inventor: Wayne C. Gensler, Allentown, Pa.

[73] Assignee: Bethlehem Steel Corporation, Bethlehem, Pa.

[21] Appl. No.: 687,778

[22] Filed: May 19, 1976

[51] Int. Cl.[2] ..... C10B 57/00; C10B 21/10

[52] U.S. Cl. ..... 201/36; 202/151; 202/144; 202/145; 202/139; 202/141; 202/142

[58] Field of Search ..... 201/36; 202/151, 144, 202/145, 139, 141, 142

[56] References Cited

U.S. PATENT DOCUMENTS

| | | | |
|---|---|---|---|
| 1,597,365 | 8/1926 | Keigley et al. | 202/151 |
| 2,098,013 | 11/1937 | Pavitt | 202/151 UX |
| 3,833,478 | 9/1974 | Tucker | 202/151 |

*Primary Examiner*—James H. Tayman, Jr.
*Attorney, Agent, or Firm*—Joseph J. O'Keefe; John J. Selko

[57] ABSTRACT

A single regenerative coke oven battery is constructed and operated as a plurality of individual and separate groups of heating walls, each group capable of independent reversal and heating cycles. During slow-down operations, one or more of the individual groups of heating walls is shut down for a preselected time period, with no flow of combustion air, fuel and waste gas in the heating walls, while the remainder of the groups are operated at substantially full air and gas flow. The battery is capable of a slow-down operation while avoiding uneven coking and variations in the amount of by-product coke oven fuel gas generated.

6 Claims, 6 Drawing Figures

1
3
7
9
9A
9B
9C
9D
9E
11
11A
11B
11C
11D
13
15
15A
15B
15C
15D
15E
17
17A
17B
17C
17D
17E
17F
18
19
21
22
23
25
34
5

1
2
2
34
34
34
36
A
B
C
D
46
46
58
58
68
68
70
70'
72
72'
74
74'
82
82
84
86

A
A'
B
B'
C
C'
D
D'
84
86
90
92
98

A
R1
R2
R2
R3
98
100
102
104

COKE OVEN BATTERY AND METHOD FOR OPERATION ON A SLOW-DOWN BASIS

BACKGROUND OF THE INVENTION

This invention relates to regenerative coke oven batteries and their operation. More particularly, it relates to a single coke oven battery which is constructed and operated as a plurality of individual and separate units capable of independent reversal and heating cycles.

From time to time during the operation of a coke oven battery, due to strikes or other economic reasons, it becomes necessary to operate the battery on a slow-down or stand-by basis.

In conventional batteries, a slow-down is accomplished by reducing the underfiring gas flow and changing the air inlet valves and exhaust stack valves to reduce flow rates in the battery. Such procedures can cause a change in the pressure drop across the air and gas distribution system of the battery. Therefore, the heat distribution across the width of the battery is affected, leading to uneven coking, with one side of the battery being overheated and the other side being underheated.

Another technique is to stop all flow of gas and air in the entire battery for an extended time during a reversal. Such procedure can cause a large variation in by-product gas flow. This variation, in a steel plant where other operations depend on the coke oven for fuel gas, is undersirable. During the extended off-periods, the excess gas may have to be flared, and during the normal operating periods, natural gas may have to be used to make up the deficit in plant gas supply.

SUMMARY OF THE INVENTION

I have invented a heating system arrangement for a coke oven battery which can be operated on a slow-down basis without the problems of the prior art batteries. The battery of this invention is a battery which is divided into a plurality of groups of heating walls, each group having its own separate regenerators; each group of heating walls is reversed independently from the other groups. Timing means are provided to selectively stop all gas and air flow in each group of heating walls for a portion of a reversal period, while the remaining groups of heating walls are operated under full gas and air flow.

DESCRIPTION OF THE PREFERRED EMBODIMENTS

Figure 1:
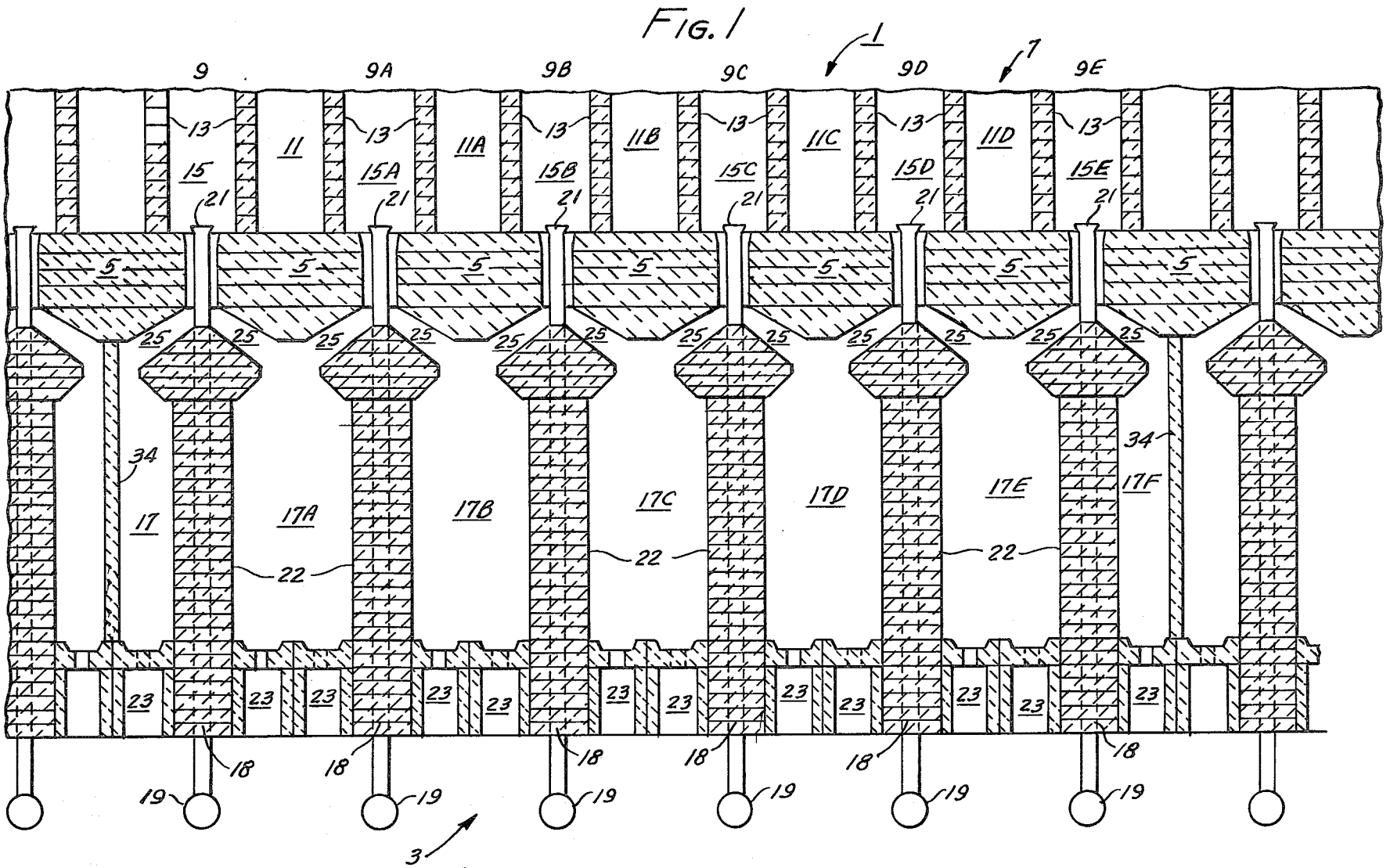
FIG. 1 is a vertical sectional view of a coke oven battery embodying the present invention.

Referring now to the drawings in detail, FIG. 1 is a fragmentary sectional view of a horizontal coke oven battery 1 embodying the present invention. The battery includes a regenerator section 3, a deck 5 overlying the regenerator section 3 and the superstructure 7 which is made up of a plurality of heating walls, a group of which are numbered 9 through 9E. Between each pair of heating walls in the group 9–9E is a coking chamber numbered 11 through 11D respectively. Each of the heating walls 9–9E is made up of two spaced apart heating wall liners 13 between which are vertically extending heating flues 15–15E. As is well known, the heating flues in each heating wall are separated from one another by transversely extending binder bricks (not shown).

The regenerator section 3 is made up of a plurality of regenerator chambers, a group of which are numbered 17 through 17F, and which extend parallel to the coking chambers 11. The regenerator chambers 17–17F are arranged to supply preheated combustion air to the heating flues 15–15E and at alternate times to remove from the heating flues waste gases resulting from the combustion of the preheated combustion air and the fuel gas. The fuel gas is conveyed to the flues 15–15E through conduits 18 which carry fuel gas from headers 19 to burners 21 in heating walls 9–9E.

The regenerator chambers 17–17F are separated by partitions 22 and are generally filled with a brickwork which absorbs the heat from the waste gases, so that said heat is available on a reverse cycle for heating combustion air passing through the regenerator chambers to the heating flues. At the bottom of each of the regenerator chambers there are bus flues 23 for supplying combustion air to the regenerator chambers and for removing waste gases from the respective generator chambers. Passages 25 are provided through the deck 5 from the regenerator chambers 17–17F to the bottom of the heating flues 15–15E. These passages 25, at alternate times, serve to supply combustion air to the heating flues 15–15E from the regenerator chambers 17–17F or permit waste gases to pass from the heating flues 15–15E to the regenerator chambers 17–17F.

A plurality of adjoining coke ovens, in this instance five ovens 11–11D are heated by a group of heating walls comprised of individual heating walls 15–15E, which group has its own independent regenerator means comprised of individual regenerators 17–17F. Each independent regenerator means is separated from the adjoining independent regenerator means by partition 34 which extends from the base to the top of the regenerator section 3. Partition 34 extends the entire width of the coke oven. Thus it can be seen that a plurality of individual and separate coke ovens are heated by a group of heating walls, which heating walls are served by a separate regenerator means comprised of a plurality regenerators. Although it is not shown, it should be understood that the entire battery is likewise divided into several independent and separate groups of ovens, heating walls and regenerator means.

Figure 2:
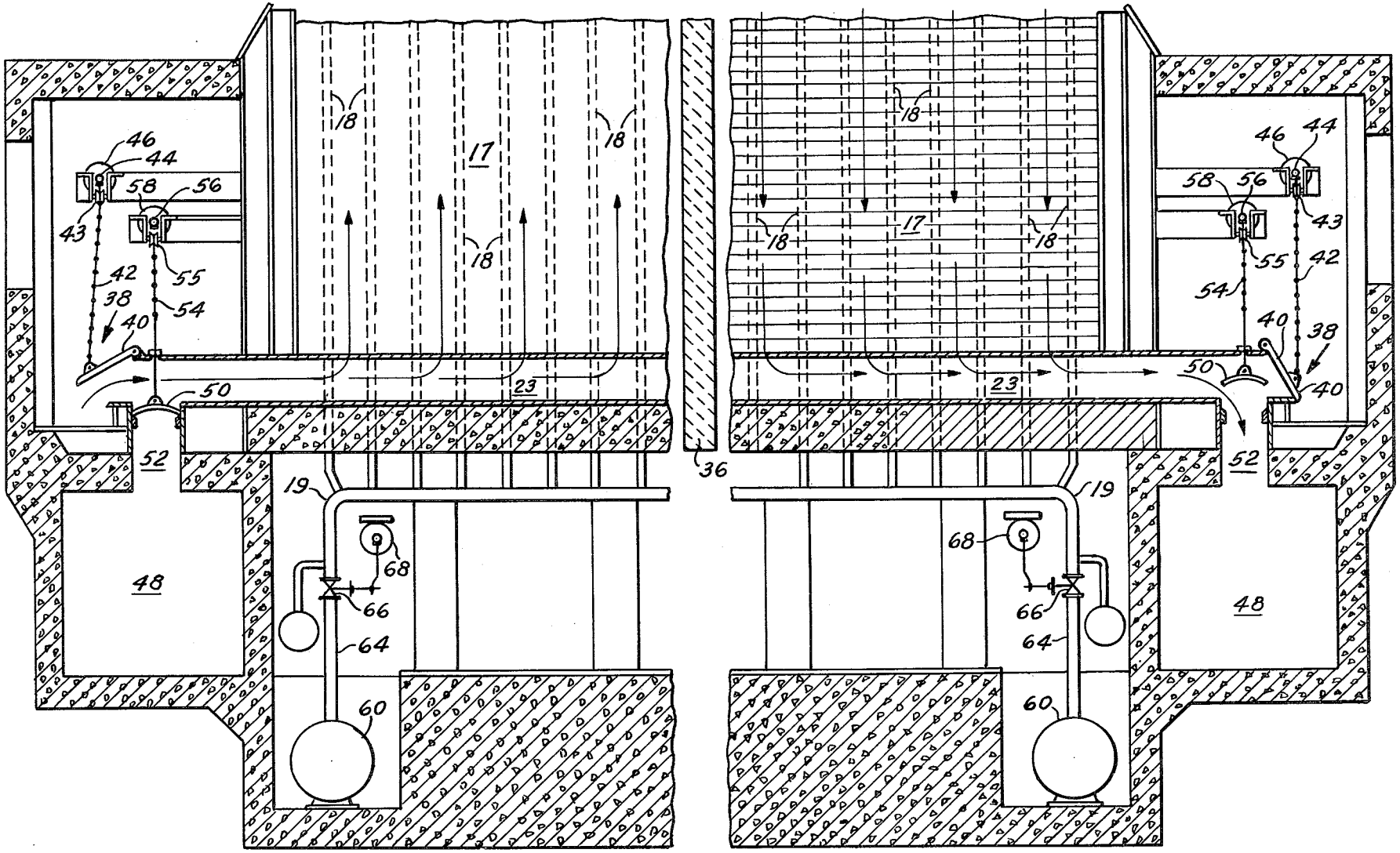
FIG. 2 is a composite vertical section taken crosswise of the battery, the left hand portion being taken through a heating wall, and the right hand portion being taken through a coking chamber and regenerator chamber.

FIG. 2 is a composite vertical section taken crosswise to the battery, the left hand portion being taken through a heating wall, and the right hand portion being taken through a coking chamber and regenerator chamber. In this instance the battery is a double divided battery. Thus, each regenerator 17–17F is divided into two sections by partition 36 which extends from bottom to top of regenerator section 3 and runs the entire length of battery 1.

Each regenerator in the group 17–17F is equipped on coke and pusher side with an air box 38 which is opened and closed by an air valve 40. Air valve 40 is opened and closed by chain 42 connected over wheel 43 to a shaft 44 which is horizontally reciprocated by conventional hydraulic cylinder 46. As shaft 44 reciprocates, all valves 40 for the regenerators 17–17F are simultaneously opened or closed. The air valve configuration is well known, and conventional in design and opening and closing operation. As is well known, and indicated by the arrows, combustion air enters regenerators 17 through bus flue 23 and passes through heating flues 15 (not shown). The combustion air is mixed and burned with fuel in the heating flues 15, and exits to exhaust stacks, not shown, via bus flues 23 and chimney flue 48.

Each regenerator is connected to the chimney flue 48 by means of stack valve 50 and passageway 52. Stack valve 50 is opened and closed by chain 54 which connects over wheel 55 to shaft 56 that is horizontally reciprocated by hydraulic cylinder 58. The arrangement and opening and closing of the exhaust valve is similar to that described for air valves 40, and is conventional and well known.

As is shown in FIG. 2, one air valve 40 is up and therefore open while the stack valve 50 is down and therefore closed. At the other side of the battery, the valve positions are the opposite. On each reversal, the respective air valves 40 and stack valves 50 change from opened to closed, causing a reversal of flow of combustion air and waste gas through each group of heating walls 9–9E. It should be apparent that by simultaneously closing all air valves 40 and exhaust stack valves 50, for regenerators 17–17F, one can provide a neutral period wherein combustion air and waste gas flow in the associated heating walls 9–9E and regenerators 17–17F can be substantially stopped.

Also shown is a conventional fuel gas line 60 operably connected to header 19 which feeds each burner 21 by means of passageways 18. Positioned in pipes 64 is a gas reversing cock valve 66 of conventional design.

In response to the urging of a hydraulic cylinder 68, gas cock 66 can stop or start gas flow in header 19 during a reversal period. During a neutral period gas reversing cock 66 can be closed to stop all gas flow to heating walls 9–9E. The gas cock operation is also conventional and well known. Therefore, it can be understood that during a neutral period of a reversal, when all air valves 40, stack valves 50 and gas cocks 66 are closed, no flow of combustion air, waste gas, or fuel gas will take place in the one group of heating walls and associated regenerators served by the closed valves. Flow of air, fuel and waste gas through the remainder of the battery continues uninterrupted, and at substantially the same rate and pressures as established during operation of the entire battery.

Figure 3:
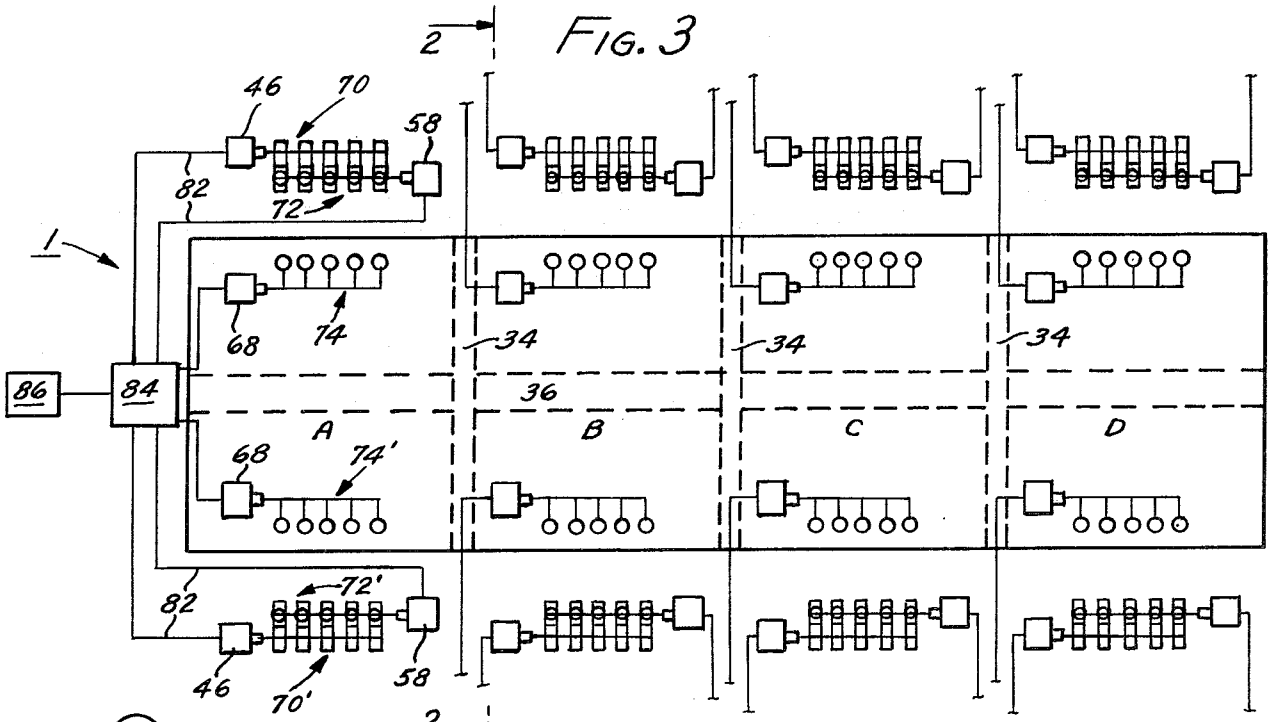
FIG. 3 is a schematic representation of the coke oven battery of the invention divided into a plurality of groups of heating walls, and associated reversal means.

FIG. 3 shows a schematic representation of a coke oven battery 1 divided into a plurality of groups of heating walls. In the case shown, there are four groups A, B, C, and D. However, any convenient number, two or more, can be selected.

Each group of heating walls has its own independent regenerator means, as hereinbefore described. Also shown are partitions 34 which separate each independent regenerator means from the adjoining regenerator means. Partition 36 separates each regenerator means into halves, making a double-divided battery. Thus, it can be seen that the battery is divided into a plurality of groups of coke oven heating walls, each group having its own independent regenerator means separate from the other regenerator means for the other groups. In addition, each independent regenerator means, can be closed, or turned off, so as to substantially stop all flow of gases in the heating walls served by that particular regenerator means.

Referring again to FIG. 3, each group of heating walls, A-D has its own separate reversal means comprising air valve reversal means 70 and 70', stack valve reversal means 72 and 72', and gas cock reversing means 74 and 74'. Each separate reversal means 70, 70', 72, 72', 74, 74' is operably connected by hydraulic cylinders 46, 58 and 68 respectively and hydraulic lines 82 to a control means 84. Control means 84 is operably connected to timing means 86 which controls the independent reversal of each reversal means 70, 70', 72, 72', 74, 74'. For clarity the reversal means for only one group of heating walls is shown numbered and connected to control means 84 and timing means 86. It is obvious that the remaining groups are similarly connected.

Figure 4:
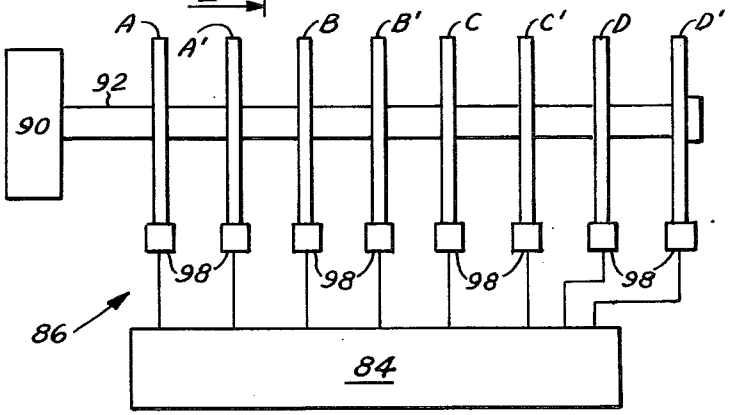
FIG. 4 is a schematic diagram of a timing means connected to the hydraulic control means of the invention, for reversing a group of heating walls separately.

Referring to FIG. 4, timing means 86 includes clock means 90 which drives shaft 92 on which are mounted a plurality of independent timing cams A, A', B, B', C, C', D, D'. Each timing cam is operably connected to a different reversal means. For example, cams A and A' operate the reversal means for group A heating walls, with cam A activating air valve reversal means 70, stack valve reversal means 72, and gas cock reversal means 74. Cam A' activates air valve, stack valve, and gas cock reversal means 70', 72', and 74' respectively.

Figure 5:
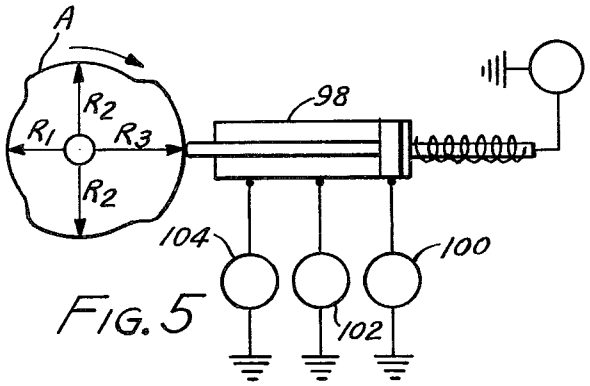
FIG. 5 is a schematic diagram of a timing cam arrangement for controlling the reversal period of one group of air, gas, and stack valves.
Figure 6:
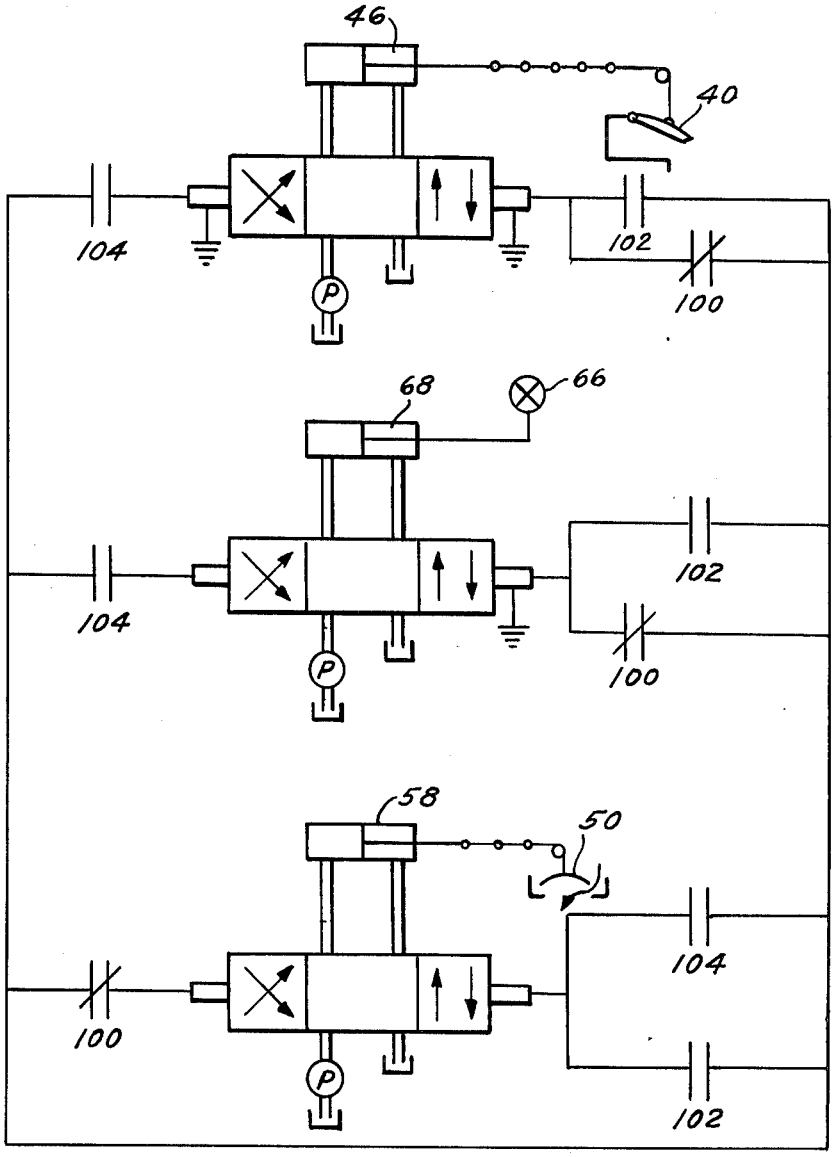
FIG. 6 is a schematic diagram of a control circuit for controlling the reversal period of one group of air, gas, and stack valves.

FIGS. 5 and 6 show one cam and its typical electronic-hydraulic control means. It is obvious that each cam is similarly arranged.

Cam A has an irregular peripheral surface, having portions $R_1$, $R_2$, and $R_3$, which press against a three-way switch 98. Switch 98 in turn is operably connected to electronic-hydraulic switching control means 84 shown schematically in FIG. 6. As cam A rotates to position $R_3$, solenoid 100 is activated, and hydraulic control cylinders 46, 58, and 68 are moved to position the air valves 40 and gas valves 66 in the closed position, and stack valves 50 in the open position. For the affected valves, this $R_3$ position is referred to as an "off" position.

When cam A rotates to position $R_2$, solenoid 100 is deactivated and solenoid 102 is activated. All air, gas, and stack valves are therefore in the closed position and substantially all flow of fuel gas, combustion air, and waste gas stops in the associated heating walls. This $R_2$ position is referred to as a "neutral" position.

When cam A moves to position $R_1$, solenoid 102 is deactivated and solenoid 104 is activated, which opens air valves 40 and gas valves 66 but closes stack valves 50. For the affected valves, this $R_1$ position is referred to as the "on" position.

It should be understood that cams A and A' coordinate their respective reversal means so that the neutral periods coincide. However, when reversal means 70, 72, and 74 are "on" (air and gas valves open and stack valves closed), reversal means 70', 72', and 74' are "off" (air and gas valves closed and stack valves open).

As is well known, the shape of the periphery of each cam can be altered to provide any desired preselected length of time for the neutral period, and the individual reversal or heating periods can be changed merely by changing the timing cam.

refer to the "on", "off", or "neutral" position on the respective cams as described above.

TABLE I

| | | "On" Reversal Time Period | | | | "Off" Reversal Time Period | | | |
|---|---|---|---|---|---|---|---|---|---|
| | | 1/4 | 2/4 | 3/4 | 4/4 | 1/4 | 2/4 | 3/4 | 4/4 |
| Group A Heating Walls | A | $R_1$ | $R_1$ | $R_1$ | $R_2$-Neutral | $R_3$ | $R_3$ | $R_3$ | $R_2$-Neutral |
| | A' | $R_3$ | $R_3$ | $R_3$ | $R_2$-Neutral | $R_1$ | $R_1$ | $R_1$ | $R_2$-Neutral |
| Group B Heating Walls | B | $R_1$ | $R_1$ | $R_2$-Neutral | $R_1$ | $R_3$ | $R_3$ | $R_2$-Neutral | $R_3$ |
| | B' | $R_3$ | $R_3$ | $R_2$-Neutral | $R_3$ | $R_1$ | $R_1$ | $R_2$-Neutral | $R_1$ |
| Group C Heating Walls | C | $R_1$ | $R_2$-Neutral | $R_1$ | $R_1$ | $R_3$ | $R_2$-Neutral | $R_3$ | $R_3$ |
| | C' | $R_3$ | $R_2$-Neutral | $R_3$ | $R_3$ | $R_1$ | $R_2$-Neutral | $R_1$ | $R_1$ |
| Group D Heating Walls | D | $R_2$-Neutral | $R_1$ | $R_1$ | $R_1$ | $R_2$-Neutral | $R_3$ | $R_3$ | $R_3$ |
| | D' | $R_2$-Neutral | $R_3$ | $R_3$ | $R_3$ | $R_2$-Neutral | $R_1$ | $R_1$ | $R_1$ |

While I have described a preferred arrangement for the electronic-hydraulic switching control means 84, it should be understood that any conventional devices will do so long as they provide the desired timing and positioning of the various air, gas and stack valves.

Thus it can be understood that the coke oven battery is divided into four individual independent operating and reversing units.

Operation

In normal operation, each group of heating walls A–D is operated in conventional manner, and is reversed at the end of a conventional time interval known as a reversal period. Each reversal period lasts for approximately 15–30 minutes. During normal operation the optimum flow rate for air, gas, and waste gas is established for the battery and is hereinafter referred to as full flow rate.

During a slow-down, one or more groups of heating walls A–D are totally shut down in the neutral position for a selected portion of each reversal period. Total shut down is achieved by substantially stopping all flow of combustion air, fuel, and waste gas in the heating walls and regenerators. The remainder of the coke oven is operated as usual at a full gas and air flow rate.

At the end of a predetermined time interval, the neutral group of heating walls is turned back on, and a second group of heating walls is shut down. By selecting the length of time each group of heating walls is in neutral, one can control the degree of coke oven battery slow-down.

Table I lists a suggested schedule for slowing down a coke oven battery by approximately 25%. The letters As can be seen from Table I, the battery is divided into four independent groups of heating walls. During the first quarter of a reversal time period, referred to as the "on" reversal time period, group D heating walls are in neutral, while the remainder of the groups are operated as usual. As the reversal period continues, group D is then turned on and group C is shut-down in neutral. In the third quarter of a reversal period, group B is in neutral and the other groups are operative. Finally, in the fourth quarter of the period, group A is in neutral and the other groups are operative. At the end of the reversal period, the cycle starts over again, but the direction of gas movement and flame is reversed in what is referred to as the "off" time period.

As can be appreciated, the actual time intervals and number of groups of heating walls can be altered to provide a different percentage of slow down.

Table II illustrates a suggested schedule for slowing down a battery by 50%.

TABLE II

| | | "On" Reversal Time Period | | | | "Off" Reversal Time Period | | | |
|---|---|---|---|---|---|---|---|---|---|
| | | 1/4 | 2/4 | 3/4 | 4/4 | 1/4 | 2/4 | 3/4 | 4/4 |
| Group A Heating Walls | A | $R_1$ | $R_2$-Neutral | $R_1$ | $R_2$-Neutral | $R_3$ | $R_2$-Neutral | $R_3$ | $R_2$-Neutral |
| | A' | $R_3$ | $R_2$-Neutral | $R_3$ | $R_2$-Neutral | $R_1$ | $R_2$-Neutral | $R_1$ | $R_2$-Neutral |
| Group B Heating Walls | B | $R_2$-Neutral | $R_1$ | $R_2$-Neutral | $R_1$ | $R_2$-Neutral | $R_3$ | $R_2$-Neutral | $R_3$ |
| | B' | $R_2$-Neutral | $R_3$ | $R_2$-Neutral | $R_3$ | $R_2$-Neutral | $R_1$ | $R_2$-Neutral | $R_1$ |
| Group C Heating Walls | C | $R_1$ | $R_2$-Neutral | $R_1$ | $R_2$-Neutral | $R_3$ | $R_2$-Neutral | $R_3$ | $R_2$-Neutral |
| | C' | $R_3$ | $R_2$-Neutral | $R_3$ | $R_2$-Neutral | $R_1$ | $R_2$-Neutral | $R_1$ | $R_2$-Neutral |
| Group D Heating Walls | D | $R_2$-Neutral | $R_1$ | $R_2$-Neutral | $R_1$ | $R_2$-Neutral | $R_3$ | $R_2$-Neutral | $R_3$ |
| | D' | $R_2$-Neutral | $R_3$ | $R_2$-Neutral | $R_3$ | $R_2$-Neutral | $R_1$ | $R_2$-Neutral | $R_1$ |

I claim:

1. In a horizontal regenerative coke oven battery including a plurality of parallel heating walls and a coking chamber between each pair of said heating walls, the improvement comprising:

a. a plurality of independent regenerator means operably connected to a plurality of groups of said heating walls, one regenerator means for each group of heating walls, each said independent regenerator means having end partitions extending across the width of said battery and from the base to the top of said regenerator means to restrict combustion air and waste gas flowing therein to only said independent regenerator means and only said group of heating walls operably connected thereto;

b. a separate reversal means for each independent regenerator means and its operably connected group of heating walls for independent reversal of each group of heating walls during a reversal period; and c. timing means for said separate reversal means for providing a neutral time in each reversal period wherein flow of gas, combustion air, and waste gas through a group of heating walls can be substantially stopped, while full flow of gas, combustion air, and waste gas can simultaneously take place in the remainder of said groups of heating walls.

2. The invention of claim 1 in which each separate reversal means includes:

a. first reversal means for reversal means for reversing a plurality of air intake valves;

b. second reversal means for reversing a plurality of stack valves;

c. third reversal means for reversing a plurality of gas cock valves; and d. control means operably connecting said timing means to said first, second and third reversal means.

3. The invention of claim 2 in which said timing means includes:

a. a clock means; and b. a plurality of independent timing cams operated by said clock means, each pair of said timing cams operably connected to one separate control means for one of said separate reversal means.

4. A method of operating at a reduced coking rate a regenerative coke oven battery wherein the direction of flow of gases comprising air, fuel gas, and waste gas through heating walls is reversed at the end of a predetermined reversal period comprising:

a. providing said battery as a plurality of separate groups of heating walls;

b. stopping substantially all flow of said gases in a first of said groups of heating walls for a predetermined portion of a reversal period;

c. simultaneously providing full flow of said gases in the remainder of said groups of heating walls;

d. at the end of said predetermined portion of a reversal period stopping substantially all flow of said gases in a different group of heating walls; and e. simultaneously providing full flow of said gases in the remainder of said groups of heating walls.

5. The invention of claim 4 in which said predetermined portion of a reversal period is less than the entire reversal period.

6. The invention of claim 4 in which the number of said groups of heating walls is four and said predetermined portion of a reversal period is about one quarter of the entire reversal period.

* * * * *